US008911268B2

(12) United States Patent
Kobayashi et al.

(10) Patent No.: US 8,911,268 B2
(45) Date of Patent: Dec. 16, 2014

(54) CONNECTOR HAVING A HOUSING WITH AN INTEGRAL LANCE FOR SECURING A TERMINAL FITTING

(75) Inventors: Tohru Kobayashi, Makinohara (JP); Shoji Yamamoto, Fujieda (JP)

(73) Assignee: Yazaki Corporation, Tokyo (JP)

( * ) Notice: Subject to any disclaimer, the term of this patent is extended or adjusted under 35 U.S.C. 154(b) by 14 days.

(21) Appl. No.: 13/818,151

(22) PCT Filed: Aug. 9, 2011

(86) PCT No.: PCT/JP2011/068496

§ 371 (c)(1),
(2), (4) Date: Feb. 21, 2013

(87) PCT Pub. No.: WO2012/026352

PCT Pub. Date: Mar. 1, 2012

(65) Prior Publication Data

US 2013/0157522 A1 Jun. 20, 2013

(30) Foreign Application Priority Data

Aug. 23, 2010 (JP) ..... 2010-185733

(51) Int. Cl.

| | |
|---|---|
| ***H01R 13/514*** | (2006.01) |
| ***H01R 13/422*** | (2006.01) |
| ***H01R 13/436*** | (2006.01) |
| ***H01R 13/426*** | (2006.01) |

(52) U.S. Cl.

CPC ..... *H01R 13/436* (2013.01); *H01R 13/4223* (2013.01); *H01R 13/426* (2013.01); *H01R 13/4361* (2013.01)

USPC ..... 439/752

(58) Field of Classification Search

CPC ..... H01R 13/6272; H01R 13/639; H01R 13/4362; H01R 13/4361; H01R 13/4223; H01R 13/4368; H01R 13/4365

See application file for complete search history.

(56) References Cited

U.S. PATENT DOCUMENTS 6,461,184 B2 * 10/2002 Nimura ..... 439/352
6,835,106 B2 * 12/2004 Aihara et al. ..... 439/752

(Continued)

FOREIGN PATENT DOCUMENTS

EP 1217697 A2 6/2002
EP 1619760 A1 1/2006

(Continued)

OTHER PUBLICATIONS

International Search Report (PCT/ISA/210), dated Oct. 6, 2011, issued by the International Searching Authority in counterpart International Patent Application No. PCT/JP2011/068496.

(Continued)

*Primary Examiner* — Chandrika Prasad
(74) *Attorney, Agent, or Firm* — Sughrue Mion, PLLC

(57) ABSTRACT

A connector includes a connector housing having a terminal accommodating chamber, and a terminal fitting, and a lance. The terminal fitting includes: a lance sliding part formed in a shape of a flat face parallel to an inserting direction of the terminal fitting; a lance abutting part formed in a shape of a flat face which is different in level from the lance sliding part by a stepped part; and a lance engaging part. The lance includes a terminal engaging part which engages the lance engaging part; a terminal slide part which slides on the lance sliding part during an inserting process of the terminal fitting into the terminal accommodating chamber; and a chamfered part and a terminal abutting part which are located between the terminal engaging part and the terminal slide part.

2 Claims, 10 Drawing Sheets

(56) References Cited

U.S. PATENT DOCUMENTS

| | | | | |
|---|---|---|---|---|
| 6,935,905 | B2 * | 8/2005 | Aihara et al. | 439/752 |
| 8,678,866 | B2 * | 3/2014 | Hiraishi | 439/752 |
| 2001/0034167 | A1 | 10/2001 | Ketelsleger | |
| 2002/0081913 | A1 | 6/2002 | Tabata et al. | |
| 2004/0147175 | A1 * | 7/2004 | Aihara et al. | 439/752 |
| 2004/0203287 | A1 | 10/2004 | Itou et al. | |
| 2005/0020132 | A1 * | 1/2005 | Aihara et al. | 439/595 |
| 2009/0124114 | A1 * | 5/2009 | Ishikawa | 439/372 |
| 2010/0048054 | A1 | 2/2010 | Okayasu | |
| 2011/0143588 | A1 * | 6/2011 | Chikusa | 439/595 |
| 2011/0189899 | A1 * | 8/2011 | Suzuki | 439/733.1 |
| 2013/0165000 | A1 * | 6/2013 | Shinkawa et al. | 439/852 |

FOREIGN PATENT DOCUMENTS

| | | | |
|---|---|---|---|
| JP | 2004-247227 | A | 9/2004 |
| JP | 2004-319155 | A | 11/2004 |
| JP | 2010-49896 | A | 3/2010 |

OTHER PUBLICATIONS

Written Opinion (PCT/ISA/237), dated Oct. 6, 2011, issued by the International Searching Authority in counterpart International Patent Application No. PCT/JP2011/068496.

Office Action dated Jul. 22, 2014 issued by the Japanese Patent Office in counterpart Japanese Patent Application No. 2010-185733.

* cited by examiner

CONNECTOR HAVING A HOUSING WITH AN INTEGRAL LANCE FOR SECURING A TERMINAL FITTING

TECHNICAL FIELD

The present invention relates to a connector having a lance integrally formed in a terminal accommodating chamber of a connector housing in the connector to engage a terminal fitting with the lance.

BACKGROUND ART

For instance, a connector disclosed in PTL1 includes an insulative connector housing, an insulative spacer and an electrically conductive terminal fitting. The connector housing includes a terminal accommodating chamber and a spacer fitting part communicating with the terminal accommodating chamber. A lance having flexibility is integrally formed in the terminal accommodating chamber. When the terminal fitting is inserted into the terminal accommodating chamber by a prescribed amount while bending the lance, the bent lance is restored to an original state and is engaged with the terminal fitting. Further, when the spacer is fitted to the spacer fitting part, the terminal fitting is double engaged with the spacer. When the spacer is not fitted to the spacer fitting part, it is detected that the terminal fitting is in a half inserted state.

CITATION LIST

Patent Literature

[PTL 1] JP-A-2010-49896

SUMMARY OF INVENTION

Technical Problem

In the related connector, when an amount of insertion (an amount of push in) of the terminal fitting into the terminal accommodating chamber is slightly insufficient, there is a fear that the bent lance is not completely returned to an original state and may be stopped halfway. Further, even when the lance is stopped halfway and inserted halfway, there is a fear that the spacer may be fitted to the spacer fitting part. Now, by referring to FIGS. 10A and 10B, an explanation will be specifically described.

In FIG. 10A, a terminal fitting 3 is inserted into a terminal accommodating chamber 2 of a connector housing 1. The terminal fitting 3 is inserted into the terminal accommodating chamber 2 by a sufficient amount. The terminal fitting 3 is engaged with a lance 4 formed integrally with the terminal accommodating chamber 2. Further, the terminal fitting 3 is also engaged with a spacer 6 fitted to a spacer fitting part 5 of the connector housing 1.

However, when an amount of insertion of the terminal fitting 3 into the terminal accommodating chamber 2 is slightly insufficient as shown in FIG. 10B, the lance 4 is not returned completely to an original state. Namely, a terminal engaging part 8 of the lance 4 may be kept stopping on an edge part (an edge) of a part 7 to be engaged with the lance in the terminal fitting 3. In such a state, the spacer 6 may be possibly fitted to the spacer fitting part 5. As a reason of the above-described occurrence, since the terminal engaging part 8 is located at an end position of the lance 4, and the restoring of the lance 4 from a bent state and the engagement of the terminal fitting 3 are started at the same time after the terminal engaging part 8 passes the edge part of the part 7 to be engaged with the lance, a situation that the spacer 6 is fitted to the spacer fitting part 5 may occur as shown in FIG. 10B.

From FIG. 10B, it is understood that an engaging force between the lance 4 and the terminal fitting 3 cannot be sufficiently ensured. Further, it is understood that a half inserted state of the terminal fitting 3 cannot be assuredly detected.

Solution to Problem

The present invention is achieved by considering the above-described circumstances and it is an object of the present invention to provide a connector that can prevent a half insertion of a terminal fitting and can adequately ensure an engaging force. Further, it is an object of the present invention to provide a connector that can improve reliability in detection of a half insertion by preventing the half insertion of the terminal fitting.

In order to achieve the above object, according to the present invention, there is provided a connector comprising:

a connector housing having a terminal accommodating chamber;

a terminal fitting inserted into the terminal accommodating chamber in the connector housing; and a lance integrally formed on the terminal accommodating chamber so as to be engaged with the terminal fitting, wherein the terminal fitting includes:

- a lance sliding part formed in a shape of a flat face parallel to an inserting direction of the terminal fitting into the terminal accommodating chamber;
- a lance abutting part formed in a shape of a flat face which is different in level from the lance sliding part by a stepped part; and
- a lance engaging part located in the stepped part;

wherein the lance includes:

- a terminal engaging part which engages the lance engaging part;
- a terminal slide part which slides on the lance sliding part during an inserting process of the terminal fitting into the terminal accommodating chamber in the connector housing; and
- a chamfered part and a terminal abutting part which are located between the terminal engaging part and the terminal slide part;

wherein the chamfered part is formed in a shape of a flat face intersecting the inserting direction of the terminal fitting and formed continuously to the terminal engaging part; and wherein the terminal abutting part is formed in a shape of a flat face parallel to the lance abutting part so as to come into face contact with the lance abutting part.

Preferably, the connector further comprises a spacer which is fitted to the connector housing after the terminal fitting is engaged with the lance to secure a double engagement with the terminal fitting.

According to the present invention having the above-described features, the lance is pressed by the terminal fitting and bent during an inserting process of the terminal fitting into the terminal accommodating chamber. Then, when the terminal fitting is inserted by a prescribed amount, the lance being bent till that time is apt to return to an original state. At this time, the chamfered part of the lance slides on the terminal fitting and operates to push in the terminal fitting in the inserting direction. Since the terminal fitting that receives the operation from the lance is pushed in, the terminal fitting is accommodated without an insufficient amount of insertion and engaged with the lance returned to the original state.

When the lance is returned to the original state, the terminal abutting part abuts on the lance abutting part of the terminal fitting, so that a relatively large sound is generated due to the abutment. According to the present invention, the completion of engagement is recognized by the sound generated by the abutment, that is, an engaging sound.

Further, according to the present invention, when the spacer is fitted to the connector housing, the terminal fitting is engaged with the spacer. Since the terminal fitting is already engaged with the lance, the terminal fitting is double engaged.

When the lance is supposed to stop during the returning operation of the lance to the original state, since the chamfered part of the lance serves to push the terminal fitting in the inserting direction, the terminal fitting hardly stops at the position of the terminal engaging part. Accordingly, the terminal fitting is supposed to stop in the connecting part between the chamfered part and the terminal abutting part. However, since the connecting part is located in the base end side of the lance from the terminal engaging part, the terminal fitting stops at a position where an amount of insertion is assuredly insufficient. As a result, even if the lance stops at an intermediate part, the spacer cannot be fitted so that a half inserted state is assuredly detected.

The present invention has a structure in which the return of the lance to the original state and the engagement of the terminal fitting with the lance are not started at the same time. Further, the present invention has a structure that generates a force for pushing in the terminal fitting. Further, the present invention has a structure that generates a relatively large engaging sound.

Advantageous Effects of Invention

According to the above configuration of the present invention, even when an amount of insertion of the terminal fitting is usually slightly insufficient, the terminal fitting can be effectively assuredly engaged. According to the present invention, the terminal fitting can be effectively prevented from being half inserted and an engaging force can be adequately ensured.

According to the above configuration in the present invention, since the terminal fitting can be prevented from being half inserted as described above, a reliability regarding the detection of the half insertion by using the spacer can be effectively improved.

BRIEF DESCRIPTION OF DRAWINGS

FIGS. 3A and 3B are diagrams of a terminal fitting according to the embodiment of the present invention, wherein FIG. 3A is a plan view of the terminal fitting and FIG. 3B is a plan view showing an abutting area of the terminal fitting in a part on which the lance abuts;

FIGS. 10A and 10B are sectional views of a related connector, wherein FIG. 10A is a view showing a state that a terminal fitting is engaged with a lance and FIG. 10B is a view showing a state that a spacer is fitted to a spacer fitting part irrespective of a half inserted state of the terminal fitting.

DESCRIPTION OF EMBODIMENTS

Figure 1:
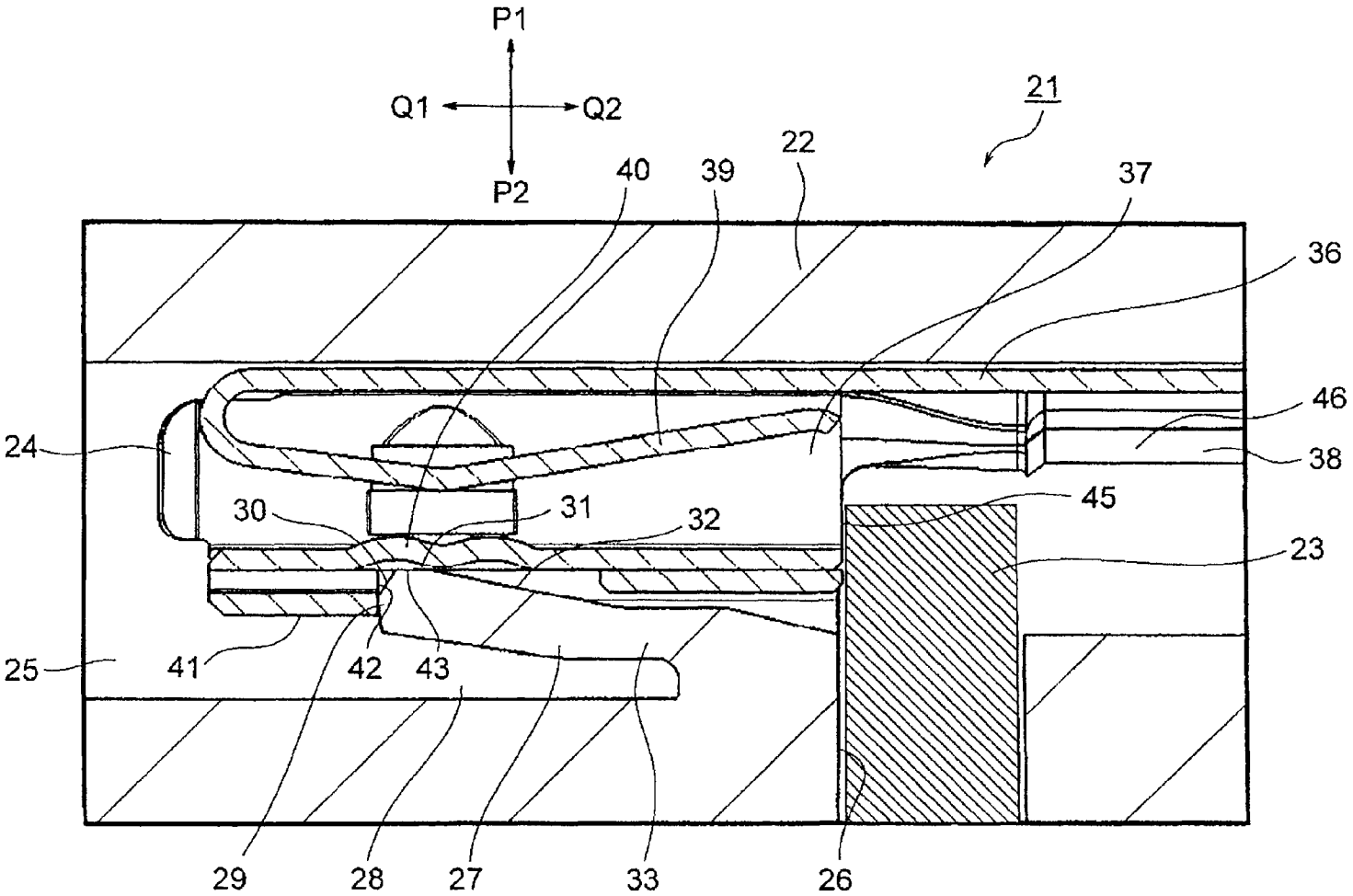
FIG. 1 is a sectional view showing a main part of a connector according to the embodiment of the present invention.
Figure 2:
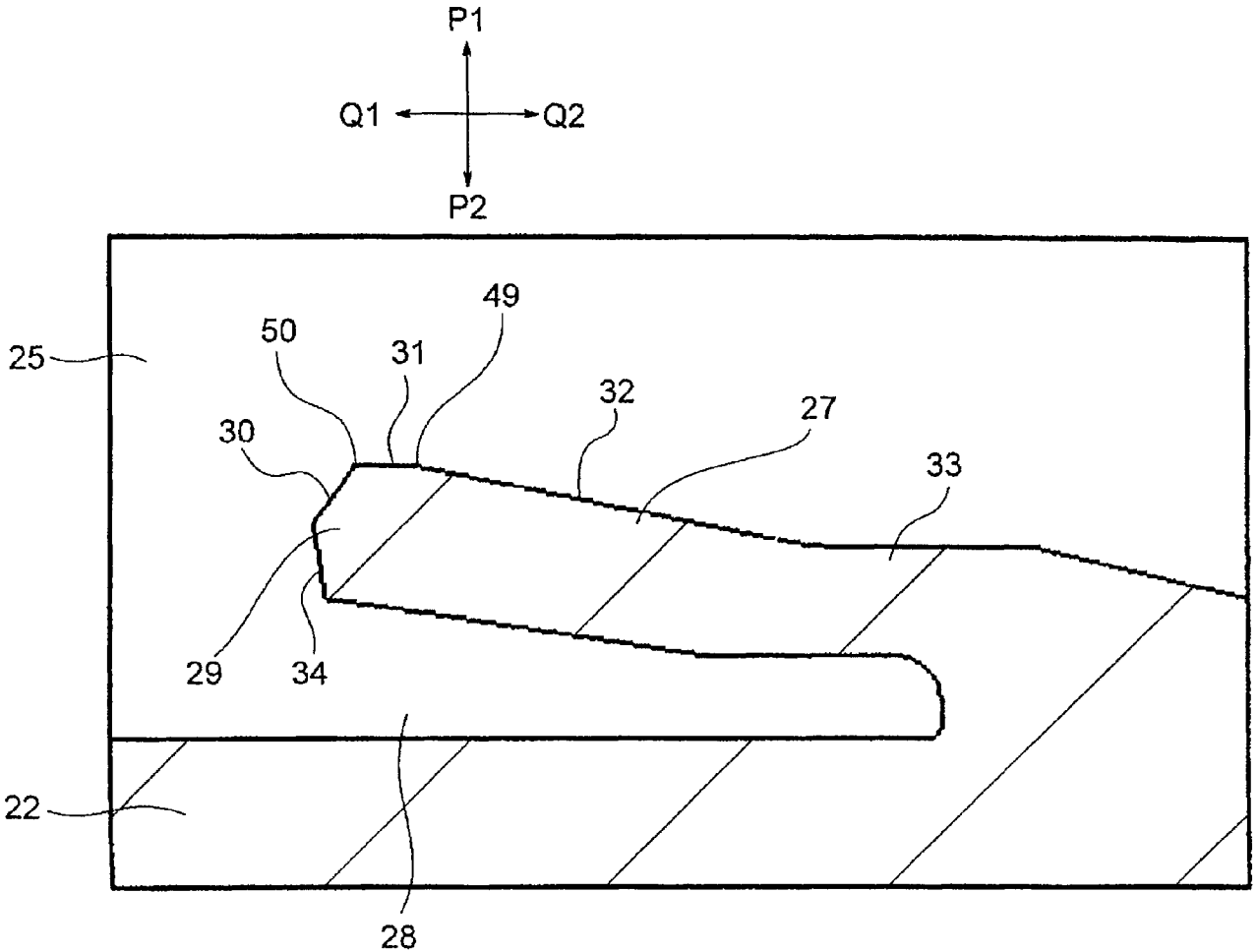
FIG. 2 is an enlarged sectional view of a lance according to the embodiment of the present invention.
Figure 3A:
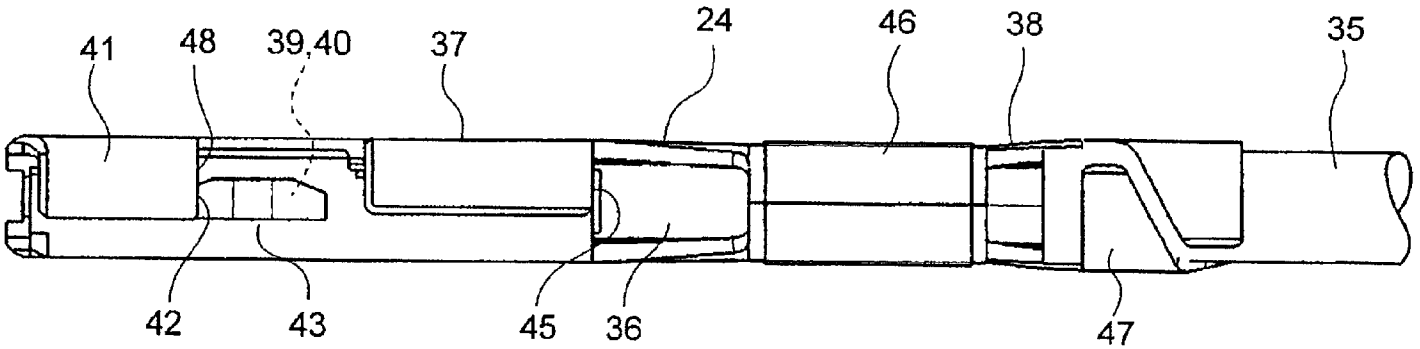
Figure 3B:
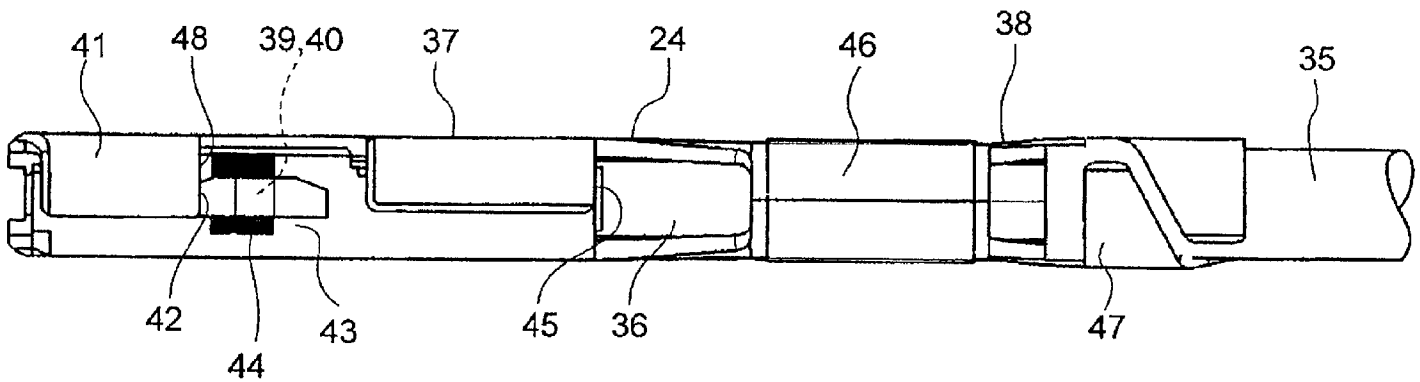
Figure 4:
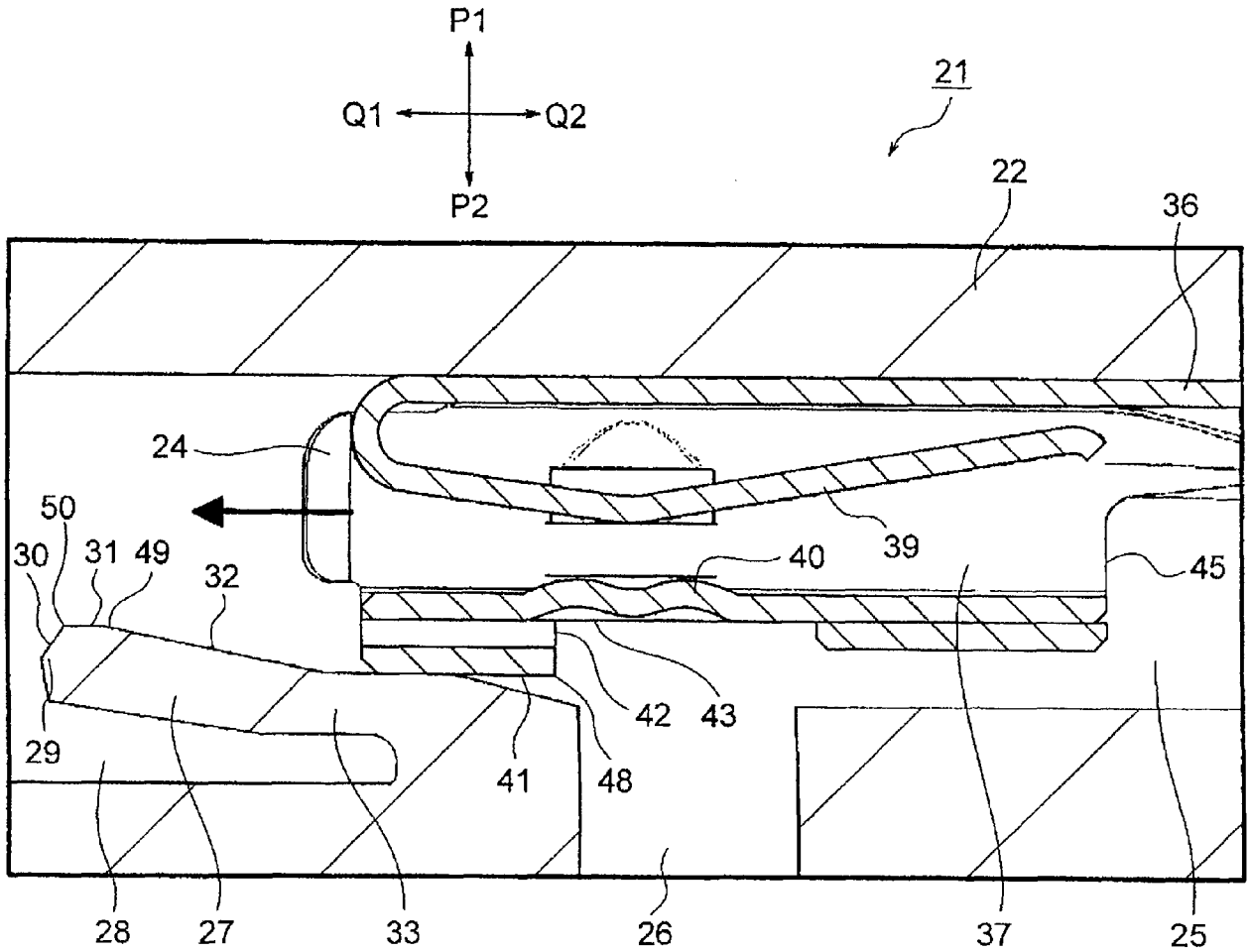
FIG. 4 is a sectional view in a terminal fitting inserting process, which shows a state immediately before the lance is bent.
Figure 5:
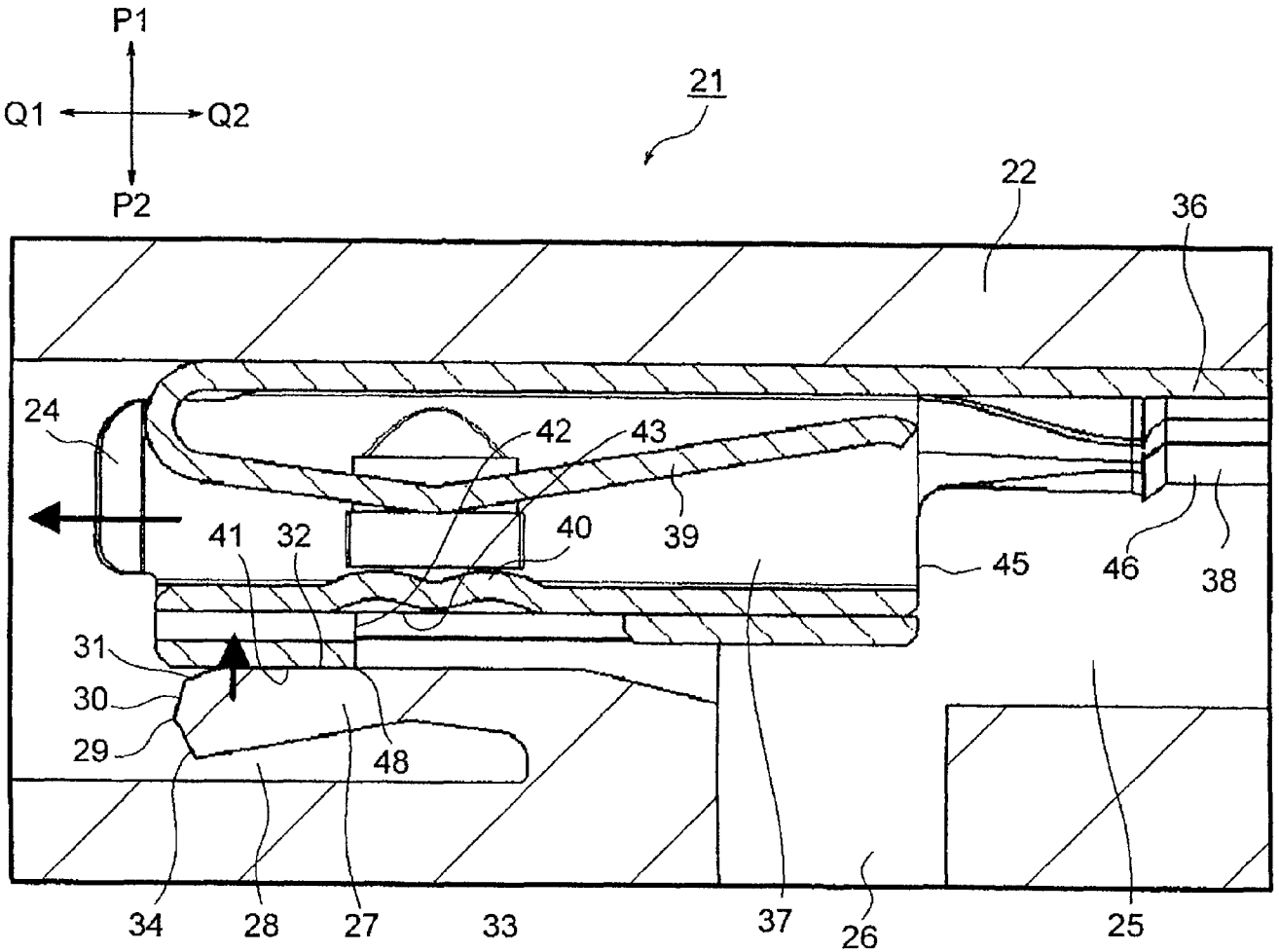
FIG. 5 is a sectional view in the terminal fitting inserting process, which shows a state that the lance is bent.
Figure 6:
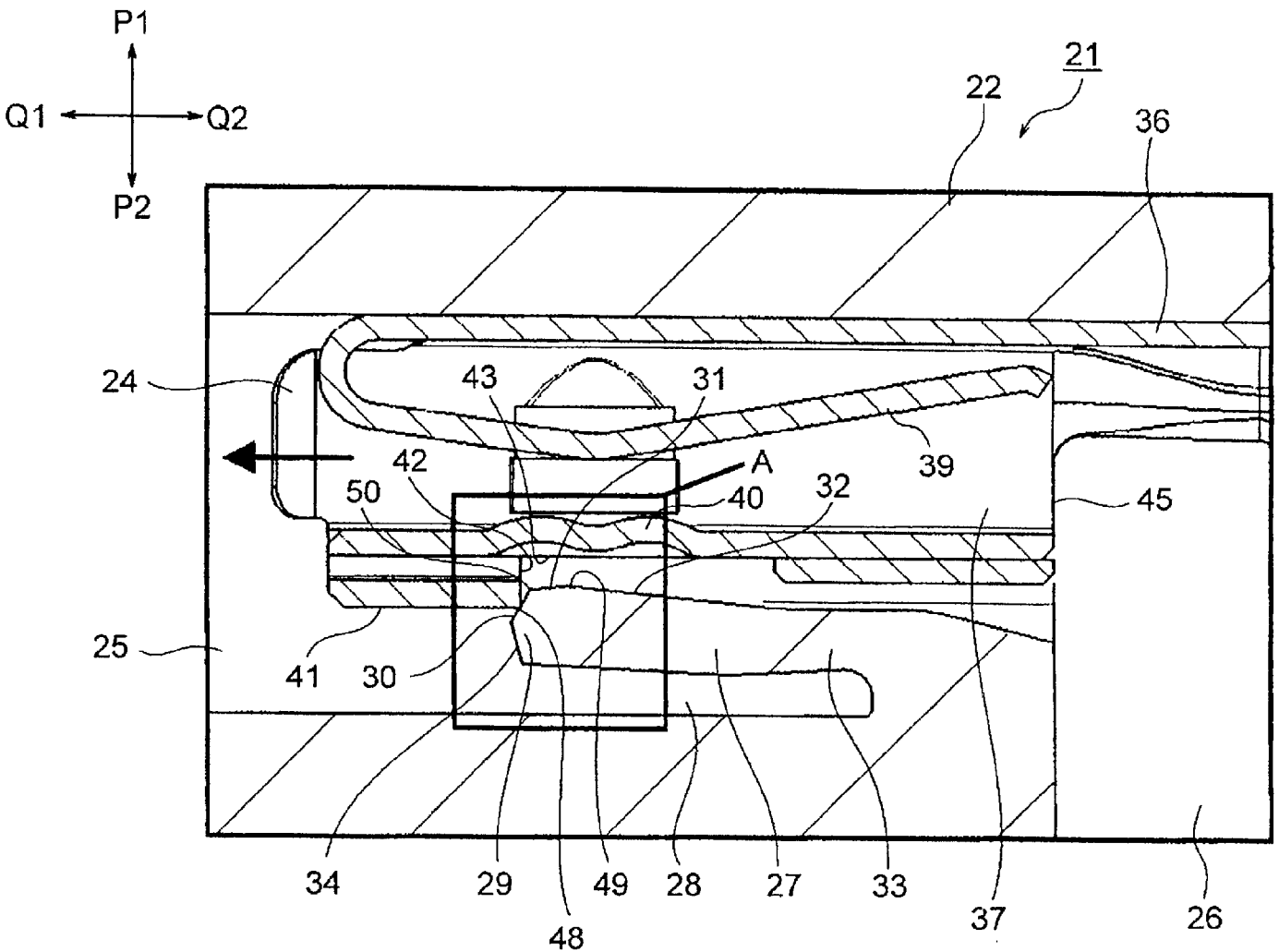
FIG. 6 is a sectional view in the terminal fitting inserting process, which shows an operation of a chamfered part.
Figure 7:
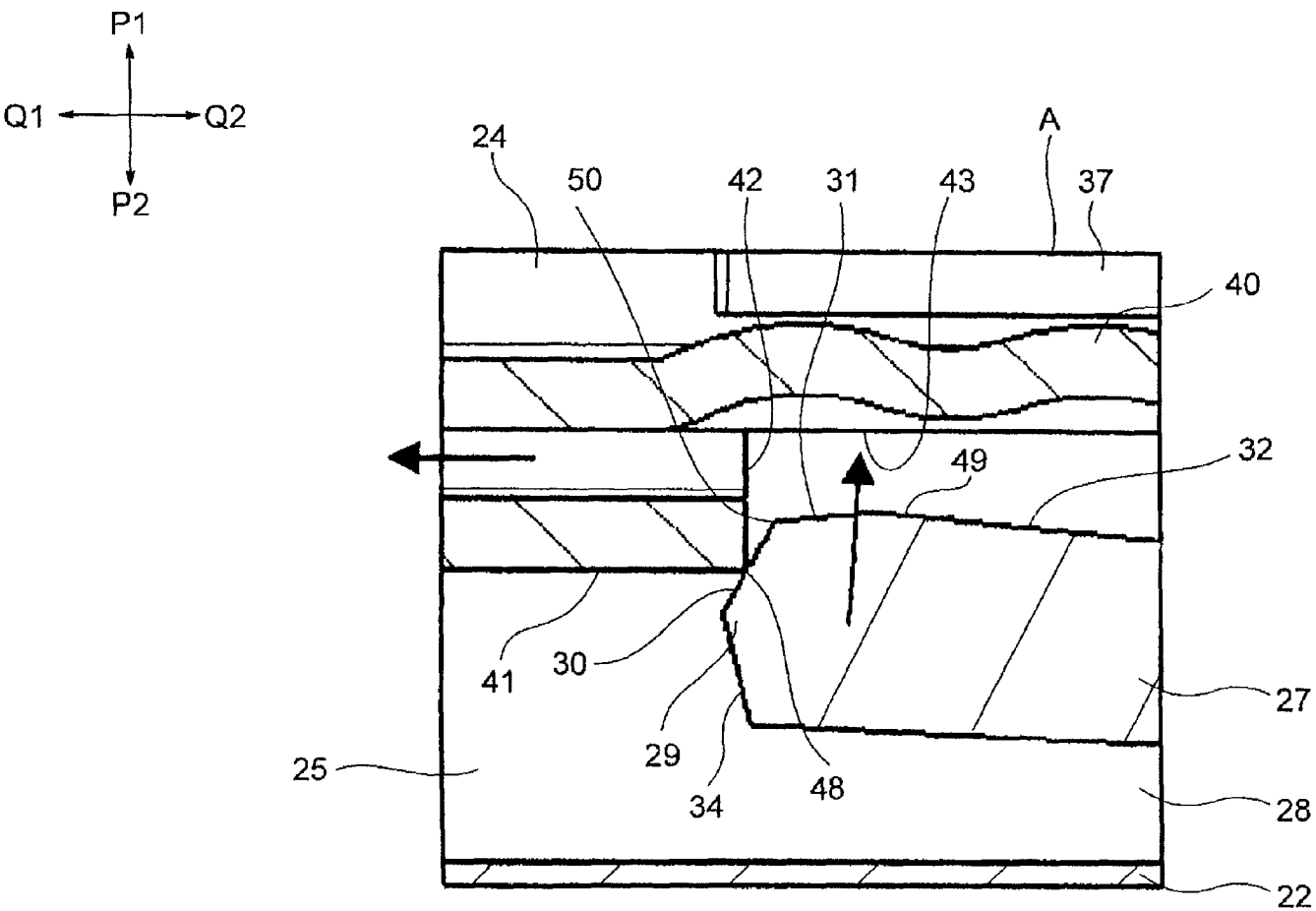
FIG. 7 is an enlarged view of a part A in FIG. 6.
Figure 8:
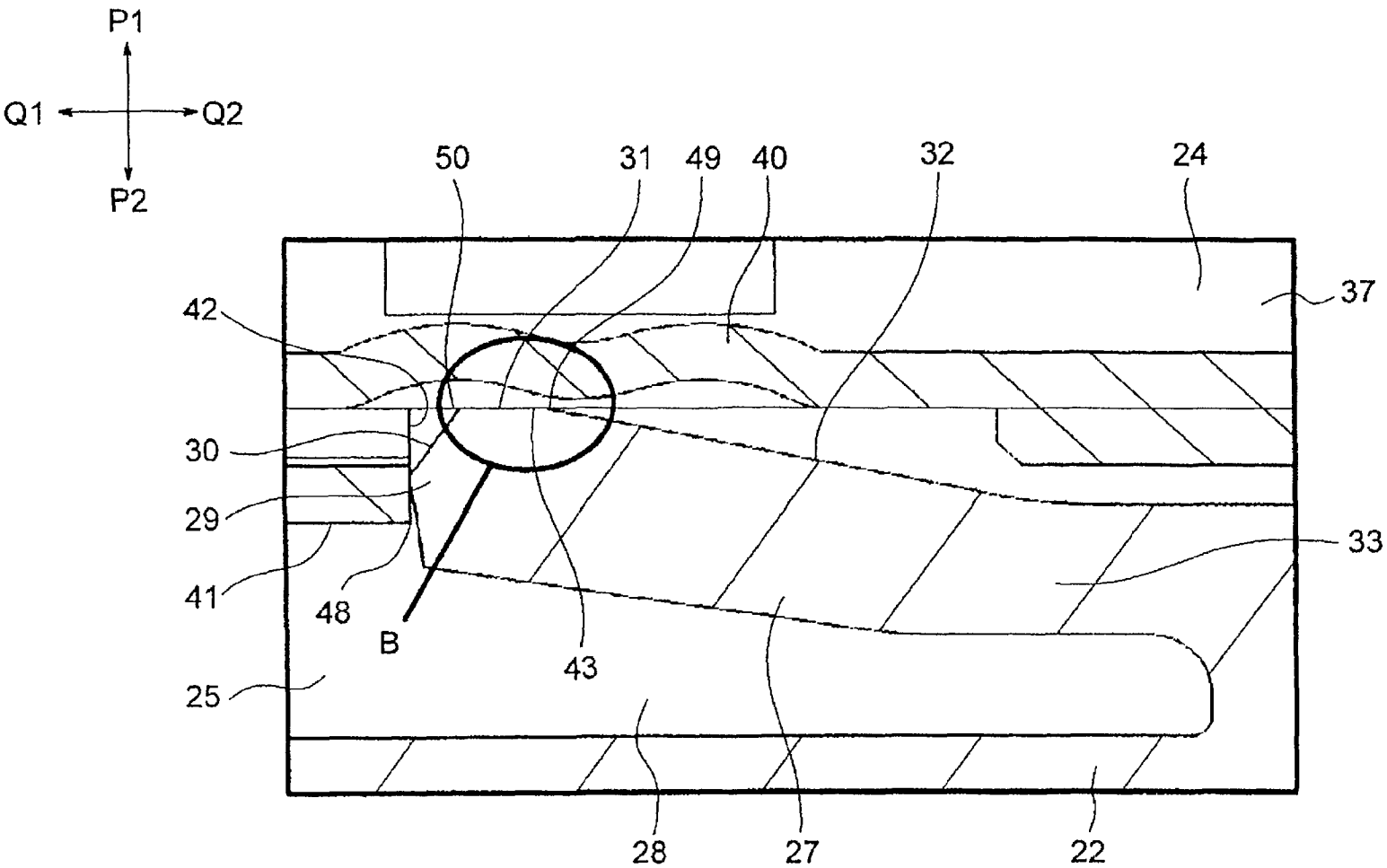
FIG. 8 is a sectional view showing a state that the terminal fitting is engaged with the lance.
Figure 9:
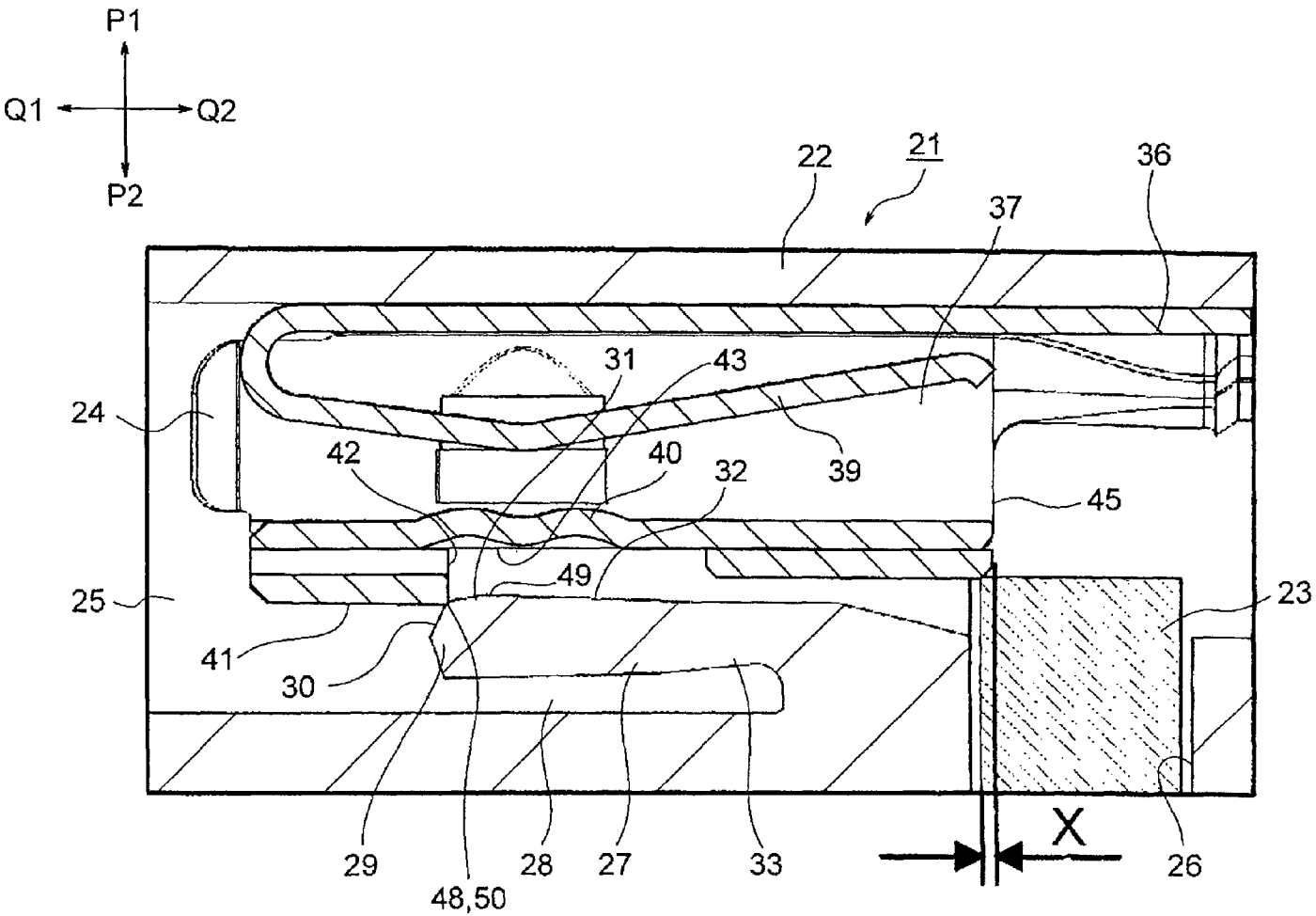
FIG. 9 is a sectional view regarding the detection of a half insertion by using a spacer.

Now, one exemplary embodiment will be described below by referring to the drawings. FIG. 1 is a sectional view showing a main part of a connector of the present invention. FIG. 2 is an enlarged sectional view of a lance. FIGS. 3A and 3B are diagrams of a terminal fitting. FIG. 4 to FIG. 6 show sectional views in a terminal fitting inserting process. FIG. 7 is an enlarged view of a part A in FIG. 6. FIG. 8 is a sectional view showing a state that the terminal fitting is engaged with the lance. FIG. 9 is a sectional view related to the detection of a half insertion by using a spacer.

In FIG. 1, a connector 21 used in various kinds of electric connections is what is called an electric connector and is provided in a terminal of a wire harness, which is not especially shown in the drawing in this exemplary embodiment. The connector 21 includes an insulative connector housing 22, an insulative spacer 23 and an electrically conductive terminal fitting 24. Initially, the structures of components of the connector will be described below.

The connector housing 22 is an injection molded product of a synthetic resin and formed so as to be fitted to a connector housing in a mate side connector which is not shown in the drawing. Specifically, the connector housing has a known locking arm. Further, the connector housing 22 is formed so as to accommodate and engage the terminal fitting 24 for achieving an electric connection. Specifically, the connector housing 22 includes a terminal accommodating chamber 25 for accommodating and engaging the terminal fitting 24 and a spacer fitting part 26 to which the spacer 23 is fitted to double engage the terminal fitting 24.

Here, when the terminal accommodating chamber 25 of the connector housing 22 is seen in section, arrow marks in the drawing are defined as described below to continue an explanation. An arrow mark P1 is defined as an upward direction, an arrow mark P2 is defined as a downward direction, an arrow mark Q1 is defined as a forward direction and an arrow mark Q2 is defined as a rearward direction. Further, a vertical direction to a sheet surface is defined as a transverse direction. It is to be understood that the upward and downward directions shown by the arrow marks P1 and P2 may be possibly reversed depending on the number or arrangement of the terminal accommodating chamber 25. Further, since the terminal accommodating chamber 25 is set as a reference, it is to be understood that during an insertion or accommodation of the terminal fitting 24, upper and lower parts for the terminal fitting 24 may be possibly reversed.

The terminal accommodating chamber 25 is formed so as to be extended in the forward and rearward directions shown by the arrow marks Q1 and Q2 like the known connector housing. The terminal accommodating chamber 25 is formed so that the terminal fitting 24 may be accommodated from a rear part to a front part and the terminal fitting 24 may be engaged by a prescribed amount of insertion. In the rear part of the terminal accommodating chamber 25, a terminal insert hole is opened and formed that is not shown in the drawing. Further, in the front part of the terminal accommodating chamber 25, a front wall of the connector housing 22 is formed that is not shown in the drawing. In the front wall, an insert hole of a terminal fitting of the mate side connector that is not shown in the drawing is opened and formed.

The terminal accommodating chamber 25 is formed so that upper, lower, right and left surfaces are respectively flat faces and the terminal fitting 24 may smoothly slide. On a lower surface of the terminal accommodating chamber 25, a lance 27 is integrally formed. The lance 27 is formed as a part that is initially engaged with the terminal fitting 24 inserted into the terminal accommodating chamber 25. The lance 27 is formed in a shape of a cantilever arm having a flexibility so as to be bent downward. Reference numeral 28 designates a bending space in which the lance 27 can be bent downward.

In FIG. 1 and FIG. 2, the lance 27 is formed so as to protrude forward and obliquely upward. Further, the lance 27 has a prescribed thickness in the vertical direction to the sheet surface. In such a lance 27, a terminal engaging part 29, a chamfered part 30, a terminal abutting part 31 and a terminal slide part 32 are continuously formed.

The terminal engaging part 29 is formed at an end position of the lance 27. The terminal engaging part 29 is formed as a part that hooks and engages the terminal fitting part 24. Specifically, the terminal engaging part is formed as a part that can hook a below-described lance engaging part 42 to regulate a rearward return. An end of the lance 27 is formed substantially in the form of a mountain and the terminal engaging part 29 is formed so as to be a top part.

The chamfered part 30 is formed in a shape of an inclined surface continuous to an upper side of the terminal engaging part 29. Further, the chamfered part 30 is formed in a shape of a flat face intersecting an inserting direction (corresponding to the direction shown by the arrow mark Q1) of the terminal fitting 24. As described below, the chamfered part 30 is formed as a part that operates to push in the terminal fitting 24 in the inserting direction.

The terminal abutting part 31 is formed in a shape of an inclined surface continuous to the chamfered part 30. Further, the terminal abutting part 31 is formed in a shape of a flat face parallel to a below-described lance abutting part 43 of the terminal fitting 24 and formed in a shape so as to come into surface contact therewith (in a shape so as to collide therewith on the surface). The terminal abutting part 31 is arranged and formed so as to be located in an upper end of the lance 27 under a state (see FIG. 2) before the terminal fitting 24 is inserted.

The terminal slide part 32 is formed in a shape of a flat face continuous to the terminal abutting part 31. Further, the terminal slide part 32 is formed to be extended toward a base end 33 of the lance 27. The terminal slide part 32 is formed as a part on which a below-described lance sliding part 41 of the terminal fitting 24 slides during an inserting process of the terminal fitting 24. The terminal slide part 32 is formed so as to be parallel (see FIG. 5) to the inserting direction of the terminal fitting 24 when the lance sliding part 41 is slid under a state that the lance 27 is bent.

Reference numeral 34 in the lance 27 designates an auxiliary engaging surface. The auxiliary engaging surface 34 is formed as a flat face opposed to the below-described lance engaging part 42 with a little inclination under a state that the terminal fitting 24 is engaged. The auxiliary engaging surface 34 may be formed in a shape of a flat face so as to come into surface contact with the lance engaging part 42.

In FIG. 1, the spacer fitting part 26 is a part to which the spacer 23 is fitted, extended in the upward and downward directions shown by the arrow marks P1 and P2 and formed so as to communicate with the terminal accommodating chamber 25 as in the known connector housing. The spacer fitting part 26 is arranged and formed so as to be opened in the rear part of the lance 27. The spacer fitting part 26 is arranged and formed at a position where the terminal fitting 24 can be engaged with the spacer 23 only when the terminal fitting 24 is inserted into the terminal accommodating chamber 25 by a prescribed amount.

The spacer 23 is formed with an injection molding of a synthetic resin similarly to the connector housing 22 and formed so as to further engage the terminal fitting 24 engaged with the lance 27. Namely, the spacer is formed so as to double engage the terminal fitting. The spacer 23 is the same as a known spacer and formed so as to hook a below-described spacer engaging part 45 of the terminal fitting 24 and regulate a rearward return.

In FIG. 1 and FIGS. 3A and 3B, the terminal fitting 24 is a metal parts formed by press working a thin metal plate and provided in a terminal of an electric wire 35 forming the wire harness. The terminal fitting 24 includes a base board 36, a box shaped electric contact part 37 formed in a front side of the base board 36 and an electric wire connecting part 38 formed in a rear side of the base board 36. The terminal fitting 24 is formed in a shape of a female type terminal.

The base board 36 is formed substantially in a belt shaped part extending straight in the forward and rearward directions. The base board 36 is a wall located in a lowermost part of the terminal fitting 24 and formed as a part sliding on an upper surface of the terminal accommodating chamber 25 in the inserting process of the terminal fitting 24 to the terminal accommodating chamber 25.

The electric contact part 37 is formed in a shape of a box as described above. The electric contact part 37 is formed so that an end is opened, which is an insert part of a terminal fitting in the mate side connector that is not shown in the drawing.

In the electric contact part 37, a terminal pressing part 39 and a terminal contact part 40 are formed. The terminal pressing part 39 is what is called a spring piece formed so as to come into contact with the terminal fitting inserted into the electric contact part 37, which is not shown in the drawing, and press the terminal fitting to the terminal contact part 40 side. The terminal pressing part 39 has an intermediate part bent, and a base end part from the bent part and the terminal contact part 40 serve as a touch part or the contact part to the terminal fitting not shown in the drawing.

In an outer part of the electric contact part 37, the lance sliding part 41, the lance engaging part 42 and the lance abutting part 43 are formed. The lance sliding part 41, the lance engaging part 42 and the lance abutting part 43 are formed on an upper surface of the electric contact part 37. The upper surface is a surface parallel to the inserting direction of the terminal fitting 24 and opposed to a lower surface of the terminal accommodating chamber 25 during the inserting process of the terminal fitting 24 to the terminal accommodating chamber 25.

The lance sliding part 41 is formed as a part on which the terminal slide part 32 of the lance 27 slides while the lance 27 is bent during the inserting process of the terminal fitting 24. The lance sliding part 41 is formed in a shape of a flat face.

The lance engaging part 42 is arranged and formed so as to be continuous to a rear end of the lance sliding part 41. The lance engaging part 42 is formed as a part hooked by and engaged with the terminal engaging part 29 located in an end part of the lance 27. The lance sliding part 41 is formed so as to be extended in the upward and downward direction. The lance engaging part 42 is arranged and formed in a stepped part between the lance sliding part 41 and the lance abutting part 43.

The lance abutting part 43 is formed as a part of a flat face as a stepped part to the lance sliding part 41 and as a parallel surface to the lance sliding part 41. The lance abutting surface 43 is formed as a part with which the terminal abutting part 31 of the lance 27 comes into surface contact in such a way that the terminal abutting part 31 of the lance 27 collides therewith. Reference numeral 44 in FIG. 3B shows an abutting area of the terminal abutting part 31 in the lance abutting part 43.

In an outer part of the electric contact part 37, a spacer engaging part 45 is formed. The spacer engaging part 45 is arranged and formed in a rear end of the electric contact part 37 and forms a part double engaged with the spacer 23.

In FIGS. 3A and 3B, the electric wire connecting part 38 is formed as a part to which the terminal of the electric wire 35 is pressure attached. The electric wire connecting part 38 is formed in a shape of a barrel. The electric wire connecting part 38 is caulked to form an electric conductor pressure attaching part 46 and a coat pressure attaching part 47.

Now, in accordance with the above-described components and structure, the accommodation and engagement of the terminal fitting 24 related to the attachment of the connector 21 will be described below.

In FIG. 4, when the terminal fitting 24 is inserted from the rear part to the front part of the terminal accommodating chamber 25, the base end 33 of the lance 27 in the terminal accommodating chamber 25 slides on the lance sliding part 41 of the terminal fitting 24. At this time, the base board 36 of the terminal fitting 24 slides on the upper surface of the terminal accommodating chamber 25.

In FIG. 5, when the terminal fitting 24 is continuously inserted, the lance 27 is bent toward the bending space 28 side in accordance with the insertion to permit the terminal fitting to be inserted. At this time, the terminal slide part 32 of the lance 27 slides on the lance sliding part 41 of the terminal fitting 24. To the lance 27, an upward repulsion force due to the bending is applied.

In FIG. 6 and FIG. 7, when the terminal fitting 24 is continuously inserted and an edge 48 as a connecting part between the lance sliding part 41 and the lance engaging part 42 in the terminal fitting 24 passes an edge 49 as a connecting part between the terminal slide part 32 and the terminal abutting part 31 in the lance 27, the lance 27 begins to return to an original state, that is, a state before the lance is bent in accordance therewith.

Further, when the terminal fitting 24 is continuously inserted and the edge 48 of the terminal fitting 24 passes an edge 50 as a connecting part between the terminal abutting part 31 and the chamfered part 30 in the lance 27, the return of the lance 27 is more advanced in accordance therewith. When the chamfered part 30 of the lance 27 slides on the edge 48 of the terminal fitting 24 in accordance with the return or reset of the lance 27, at this time, the chamfered part 30 serves to push in the terminal fitting 24 in the inserting direction through the edge 48.

Figure 10A:
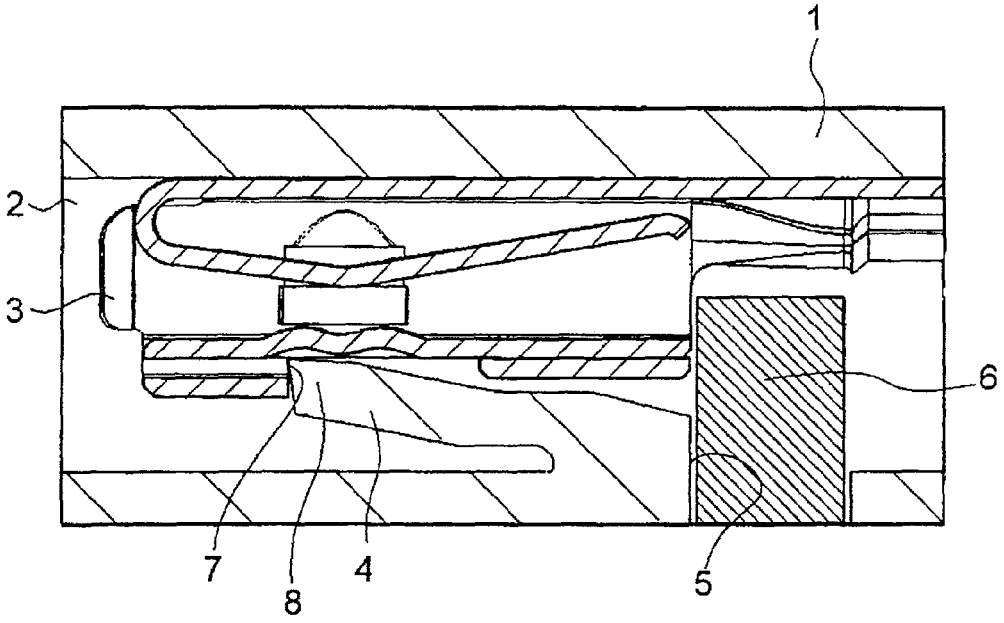
Figure 10B:
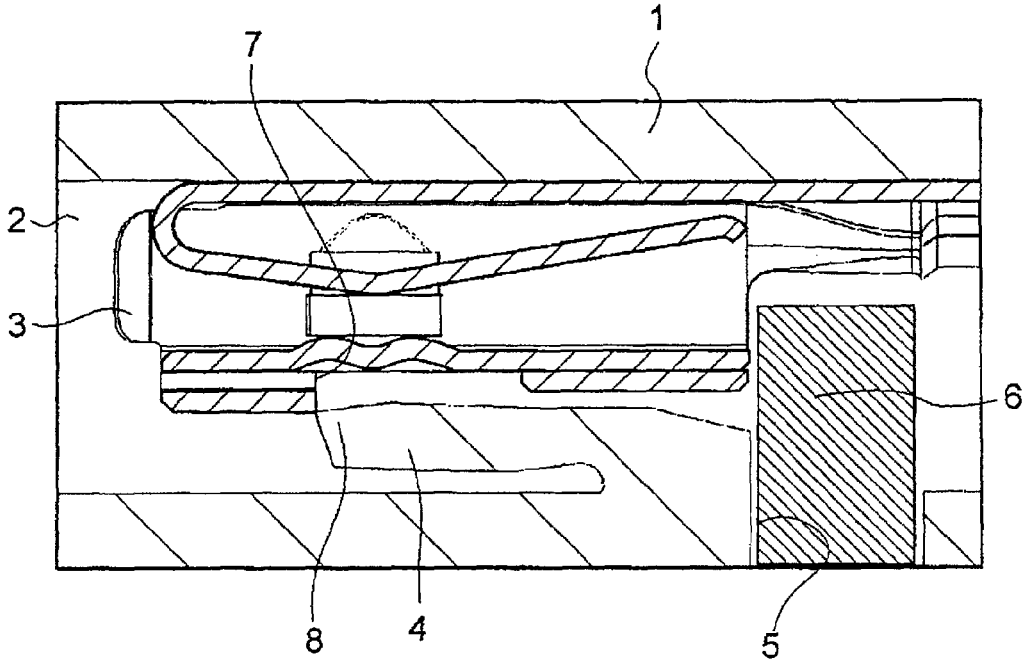

In FIG. 8, when the edge 48 of the terminal fitting 24 passes the terminal engaging part 29 of the lance 27 due to the pushing-in operation in accordance with the return of the lance 27, the lance 27 is completely returned at a stroke by the repulsion force to engage the terminal fitting 24. At this time, since the terminal abutting part 31 of the lance 27 abuts on the lance abutting part 43 of the terminal fitting 24 so as to collide therewith, a relatively large sound, for instance, a "snap" sound is generated (the sound is generated in a position B in the drawing). Accordingly, when this impact sound (an engaging sound) is heard, a completion of engagement by the lance 27 is recognized (In a form of the usual example as shown in FIGS. 10A and 10B, there is a fear that the engaging sound may be possibly very small).

When the engagement by the lance 27 is completed and the spacer 23 is fitted to the spacer fitting part 26 as shown in FIG. 1, the spacer engaging part 45 of the terminal fitting 24 is engaged with the spacer 23. When the double engagement by the spacer 23 is completed, a series of operations related to the accommodation and engagement of the terminal fitting 24 are finished.

As shown in FIG. 9, when the lance 27 is supposed to stop during the returning operation of the lance 27 to the original state, since the chamfered part 30 of the lance 27 serves to push in the terminal fitting 24 in the inserting direction, the terminal fitting hardly stops at the position of the terminal engaging part 29. As shown in FIG. 9, the terminal fitting is supposed to stop at the edge 50 as the connecting part between the chamfered part 30 and the terminal abutting part 31. However, since the edge 50 is located in a rear part of the terminal engaging part 29, the terminal fitting stops at a position where an amount of insertion is assuredly insufficient (a position where a detecting margin X by the spacer 23 occurs). As a result, the spacer 23 cannot be fitted so that a half inserted state is assuredly detected.

As described above by referring to FIG. 1 to FIG. 9, according to the present invention, even when the amount of insertion of the terminal fitting 24 is usually slightly insufficient, since a pushing-in force is applied to the terminal fitting 24 as described above, the terminal fitting 24 can be assuredly engaged. Further, according to the present invention, a half insertion of the terminal fitting 24 can be prevented and an engaging force can be adequately ensured.

Further, according to the present invention, since the half inserted state of the terminal fitting can be prevented as described above, a reliability related to the detection of the half insertion by using the spacer 23 can be improved.

It is to be understood that various modifications may be made within a range without changing the gist of the present invention.

The present application is based on Japanese Patent Application No. 2010-185733 filed on Aug. 23, 2010, the contents of which are incorporated herein by reference.

INDUSTRIAL APPLICABILITY

A connector that prevents a half insertion of a terminal fitting and adequately ensure an engaging force can be provided. Further, a connector that improves reliability in detection of a half insertion by preventing the half insertion of the terminal fitting can be provided.

REFERENCE SIGNS LIST

21 connector
22 connector housing
23 spacer
24 terminal fitting
25 terminal accommodating chamber
26 spacer fitting part
27 lance
28 bending space
29 terminal engaging part
30 chamfered part
31 terminal abutting part
32 terminal slide part
33 base end
34 auxiliary engaging surface
35 electric wire

36 base board
37 electric contact part
38 electric wire connecting part
39 terminal pressing part
40 terminal contact part
41 lance sliding part
42 lance engaging part
43 lance abutting part
44 abutting area
45 spacer engaging part
46 electric conductor pressure attaching part
47 coat pressure attaching part
48 to 50 edge

The invention claimed is:

1. A connector comprising:

a connector housing having a terminal accommodating chamber;

a terminal fitting inserted into the terminal accommodating chamber in the connector housing; and a lance integrally formed on the terminal accommodating chamber so as to be engaged with the terminal fitting, wherein the terminal fitting includes:

a lance sliding part formed in a shape of a flat face parallel to an inserting direction of the terminal fitting into the terminal accommodating chamber;

a lance abutting part formed in a shape of a flat face which is different in level from the lance sliding part by a stepped part; and a lance engaging part located in the stepped part;

wherein the lance includes:

a terminal engaging part which engages the lance engaging part;

a terminal slide part which slides on the lance sliding part during an inserting process of the terminal fitting into the terminal accommodating chamber in the connector housing; and a chamfered part and a terminal abutting part which are located between the terminal engaging part and the terminal slide part;

wherein the chamfered part is formed in a shape of a flat face intersecting the inserting direction of the terminal fitting and formed continuously to the terminal engaging part;

wherein the terminal abutting part is formed in a shape of a flat face parallel to the lance abutting part so as to come into face contact with the lance abutting part; and wherein the lance sliding part of the terminal fitting is configured to remain parallel to the lance abutting part of the terminal fitting when the terminal slide part of the lance slides on the lance sliding part of the terminal fitting during the inserting process of the terminal fitting into the terminal accommodating chamber in the connector housing.

2. The connector according to claim 1, further comprising:

a spacer which is fitted to the connector housing after the terminal fitting is engaged with the lance to secure a double engagement with the terminal fitting.

* * * * *